United States Patent [19]

Palmieri

[11] Patent Number: 4,553,466

[45] Date of Patent: Nov. 19, 1985

[54] EASY FINGERS

[76] Inventor: John Palmieri, 335 Mercer St., Stirling, N.J. 07980

[21] Appl. No.: 516,255

[22] Filed: Oct. 12, 1983

[51] Int. Cl.[4] ..... G10D 3/08

[52] U.S. Cl. ..... 84/317

[58] Field of Search ..... 84/315–317, 84/319

[56] References Cited

U.S. PATENT DOCUMENTS

| | | | |
|---|---|---|---|
| 756,743 | 4/1904 | Verrecchio | 84/317 |
| 808,510 | 12/1905 | Buchanan | 84/315 |
| 4,428,273 | 1/1984 | Favron | 84/317 |

FOREIGN PATENT DOCUMENTS

| | | | |
|---|---|---|---|
| 0033176 | 10/1885 | Fed. Rep. of Germany | 84/315 |

*Primary Examiner*—Benjamin R. Fuller

*Attorney, Agent, or Firm*—Arthur L. Plevy

[57] ABSTRACT

There is disclosed a lever apparatus which is adapted to be used on the neck of a musical instrument such as a guitar or other string instrument. The apparatus contains a plurality of spring biased lever arms each of which are pivotally mounted to a common rod by means of an associated U-shaped member. Each lever arm is directed parallel to an associated string of the instrument and has at one end an elastomeric pad which is positioned in a first position to be out of contact with the string. In a second position the user applies pressure to the lever arm with his finger which moves the pad into contact with the string. As soon as pressure is released, the spring automatically returns the arm to the first position. By using the common rod, multiple arrays of such lever arms can be mounted on the neck of the instrument to enable the user to access any string as well as at different fret locations. The nature of the mechanism is such that the same spot on each string will be accessed by the selective actuation of the lever arms.

20 Claims, 13 Drawing Figures

EASY FINGERS

BACKGROUND OF THE INVENTION

This invention relates to string instruments in general and more particularly to a lever or lever arm mechanism which when actuated will contact a string of a musicial instrument.

As one can ascertain, there are many stringed instruments in existence such as guitars, banjos, ukuleles, mandolins and so on which require the user to depress the strings in order to obtain a particular note or a particular chord. Many people have found it difficult to play a string instrument due to the fact that pressing of the strings by the use of the finger tips causes the finger tips to become sore or numb. As such, many people have been discouraged from practicing for long periods of time.

Thus the prior art has utilized many different devices to circumvent this problem including placing thimble like structures over the user's finger tips as well as finger pads and other devices. In any event, these devices are difficult to use and do not give the musician the proper feel for actuating the strings of the instrument.

BRIEF DESCRIPTION OF THE PREFERRED EMBODIMENT

A selectively operated lever apparatus to enable the playing of a stringed musical instrument such as a guitar, a banjo or the like, said instrument including a head and a neck section depending therefrom and a plurality of strings directed from said head to neck section, the apparatus comprising a rod directed across said neck section and positioned above the strings and transverse thereto, a pivotable housing coupled to said rod, an elongated lever arm secured to the top of said housing at one end and extending above and parallel to at least one of said strings at the other end, a contact pad located on said lever arm at said other end, spring bias means coupled between said lever arm and said rod to allow said housing and therefore said rod to remain out of contact with said string in a first position and to allow said housing to pivot upon application of pressure to said arm in a second position to cause said pad to contact said string whereby said spring will return said arm to said first position when pressure is removed.

BRIEF DESCRIPTION OF THE PREFERRED EMBODIMENT

DETAILED DESCRIPTION OF THE FIGURES

Figure 1:
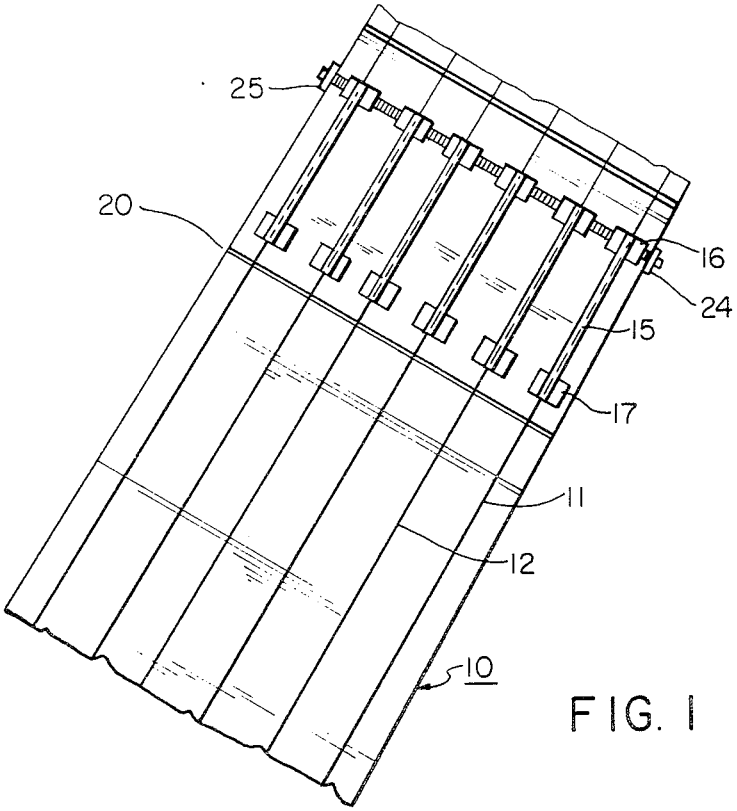
FIG. 1 is a top plan view depicting the lever actuated apparatus according to this invention.

Referring to FIG. 1, there is shown a sectional view of a neck 10 of a typical string instrument.

As indicated above, the instrument may be any of the popular type of string instruments such as guitar, banjo, ukulele, mandolin or so on. As seen in FIG. 1, the instrument normally contains a series of strings as 11 and 12 which are directed form the neck section to head section of the instrument. It is well known that by the selective activation of the strings as 11 and 12, one can produce various notes, chords and tones of varying intensity and pitch.

The strings as 11 and 12 are usually fabricated from a very thin wire or string. As indicated above, if a musician utilizes the instrument for extended periods of time, his finger tips will become sore and hence it is difficult for many people to play the instrument during a prolonged practice of musical session.

As seen in Finger 1, each string is associated with a lever mechanism which as will be explained consists of a lever arm 15 which is secured at one end to a pivotal support housing 16 and which has a pad 17 located at the other end. The pad 17 may be a piece of hard rubber or plastic and essentially acts as does a finger tip by contacting the string. In this manner, the pad 17 will contact the string when the musician activates the lever arm 15. The lever arm 15 as will be further explained is biased by means of a spring mechanism so that it is out of contact with the string but when moved toward the string, the pad 17 contacts the string.

As soon as the lever is released or the pressure removed by the musician, the lever arm returns to its quiescent condition via the spring action. As one can see in FIG. 1, there are six lever arms each of which has six pads as 17 and each of which is aligned along an appropiate string of the instrument at the location of the first fret 20.

In this manner the musician can activate any one or more of the six lever arms and does so as if he were playing the instrument in a normal manner. An important feature is that the lever arms 15 are aligned so that they are completely parallel to the associated string and located above the string. Hence the user can contact the lever arm 15 with ease and at the same time preventing his finger tips from touching the thin strings of the instrument.

The pad 17 associated with the lever arm will always contact the string at the same spot hence enabling the user to obtain the same note during each actuation. This is extremely important due to the fact that one can gain a greater consistency in playing because actuation of the lever arm will always cause the string to be contacted at the same spot.

Figure 2:
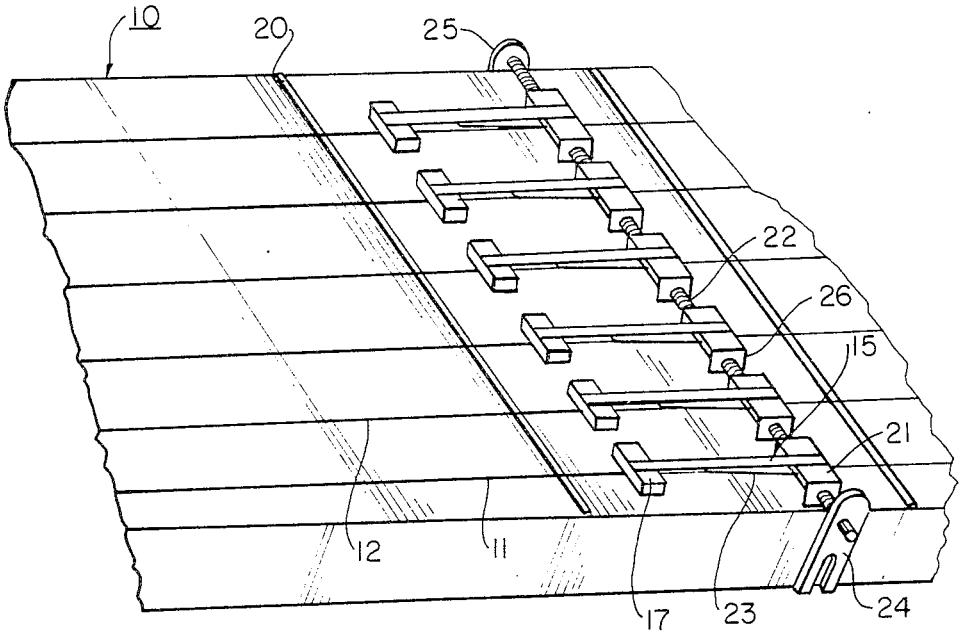
FIG. 2 is a perspective plan view of the apparatus of FIG. 1.

Referring to FIG. 2, there is shown a more detailed view of the neck 10 depicting the exact nature of the lever arm. As one can ascertain from FIG. 2, the series of lever arms which are associated with the first fret 20 are again depicted. Each lever arm as 15 has secured to one end a pad 17. The lever arm 15 may be fabricated from brass tubing. Each arm is associated with a U-shaped base member 21 which member 21 is pivotally coupled to a rod 22. The rod 22 has secured thereto one end of a wire spring 23 having the other end coupled to the lever arm. Each associated lever arm and assembly is spaced one from the other on the rod, 22 by means of the spacers 26 which may be washers or other types of devices. The entire assembly is held in position by means of side supports 24 and 25 to accommodate both ends of the rod 22.

As can be seen from FIG. 2, if one depresses the lever arm as 15, the U-shaped support piece will pivot about the rod to cause the pad 17 to contact the string. The spring 23 will automatically return the lever arm to the non-contacting position as soon as the pressure is removed by the user.

Figure 3:
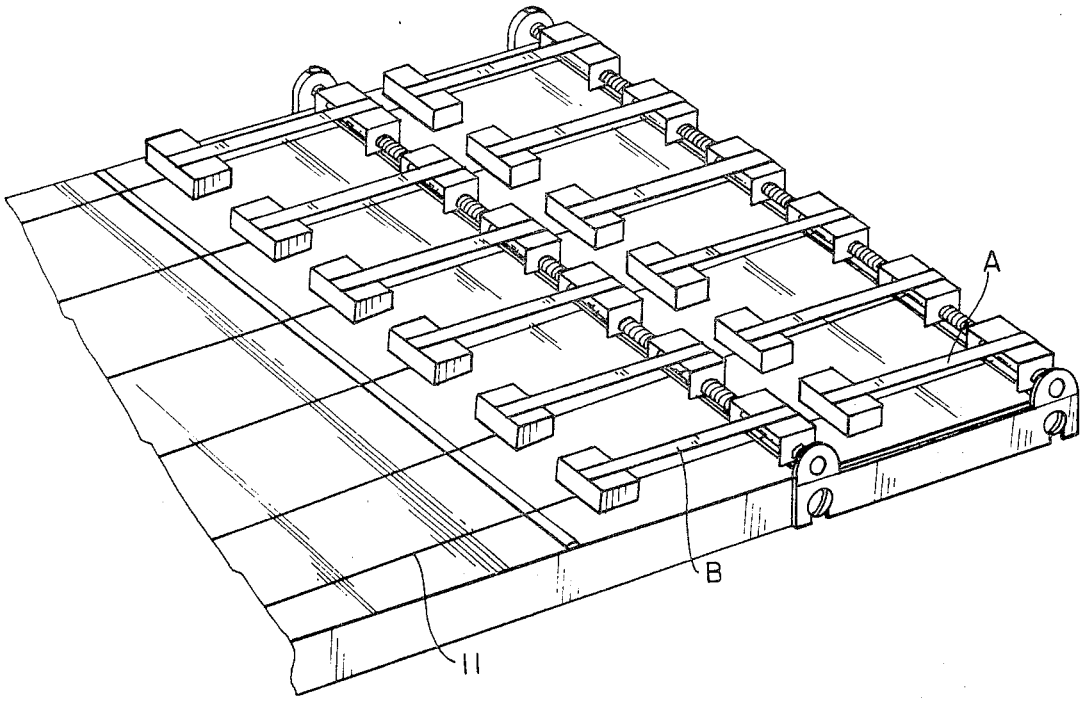
FIG. 3 is an alternate embodiment of the apparatus.

Referring to FIG. 3, there is shown two sets of lever arms with a first set of arms A aligned with the first fret and with the second set of arms B aligned with the second fret. Each of the lever arms and associated assemblies are exactly as those depicted in FIG. 2. The purpose of FIG. 3 is to show that the concept can be utilized for more than one fret.

Figure 4:
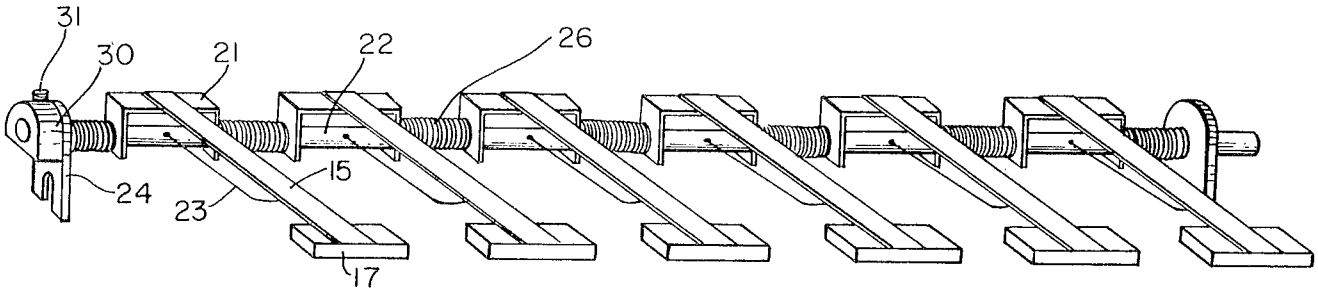
FIG. 4 is a perspective view of an assembled apparatus according to this invention.

Referring to FIG. 4, there is shown a more detailed assembly view of the mechanism. As can be seen in FIG. 4, the side supports as 24 have the top aperture encircling the rod. A metal washer or end spacer 30 firmly secures the rod to the neck of the instrument as shown in FIG. 2. A set screw 31 can be used to provide rigid coupling and for adjustment. The U-shaped support members as 21 are coupled to the rod 22. The support member 21 is pivotally mounted and the wire spring member 23 is secured to the underside of the arm 15 and to the rod 22. Each lever arm assembly is separated one from the other by means of the spacer 26. The spacers 26, therefore, allow the user to accurately space the lever arm assemblies so that each of the associated pads 17 will contact the correct string.

Figure 5:
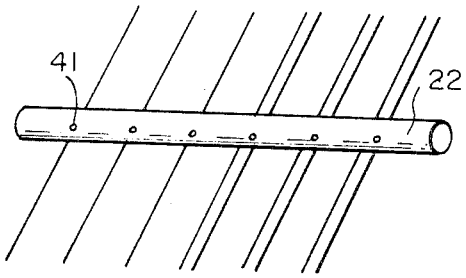
FIGS. 5 to 13 are a series of views depicting the construction and assembly of the apparatus of FIGS. 1 to 4.

Referring to FIG. 5, there is shown the rod assembly 22. Essentially, the rod assembly 22 may be fabricated from 3/32" round brass bar and has six apertures as 41 on the surface thereof. Each aperture 41 is made for example by using a number 72 drill bit. The apertures 41 are perferably in line with the strings of the instrument. It is understood that the length of the rod 22 and the number of apertures as 41 depend upon the width of the instrument neck and the amount of strings on the instrument. On different string instruments, one aperture as 41 located between the strings is sufficient.

Figure 6:
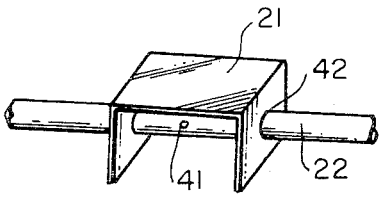

Referring to FIG. 6, there is shown the U-shaped support member 21 which is coupled to the rod 22. Essentially, the U-shaped member is relatively small and has two apertures as 42 and 43 which accommodate the rod. As can be seen from FIG. 6, the aperture 41 is located centrally to the U-shaped support member 21. The U-shaped member is 3/16" in length by $\frac{1}{8}$" in width and has sides which are $\frac{1}{8}$"$\times\frac{1}{8}$" with the apertures 42 being 3/32".

Figure 7:
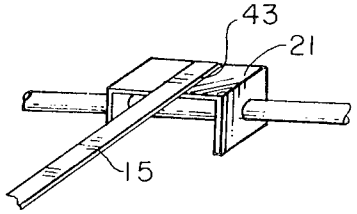

Referring to FIG. 7, the lever arm 15 which may a brass tube is approximately $1\frac{1}{2}$ mm in diameter and $1\frac{1}{8}$" long. The end 43 of the lever arm 15 is soldered to the top of the U-shaped member 21 as shown. The brass tube 15 which is the lever arm is also slightly flattened to obtain a oval cross section so that it is almost 2 mm in width to enable a user to obtain more efficient finger contact.

Figure 8:
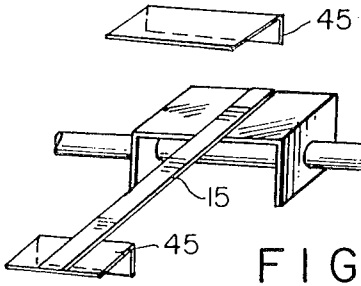

Referring to FIG. 8, at the other end of the lever arm 15, there is secured a right angle brass piece 45 which brass piece will accommodate the elastomeric pad 17 of FIG. 1. The angle piece 45 is approximately $\frac{1}{8}$" by 3/16" and the end of the lever arm 15 is soldered to the center of the angle piece 45.

Figure 9:
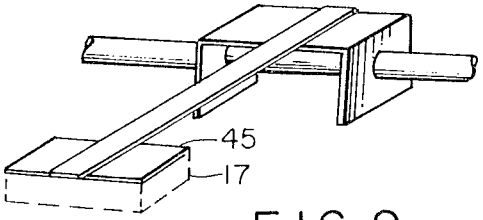

Referring to FIG. 9, the pad 17 is now glued or otherwise secured to the angle piece 45. As indicated above, the pad 17 is fabricated from plastic or hard rubber or some other suitable, elastomeric material. The dimensions of the pad are $\frac{1}{8}$"$\times$3/16".

Figure 10:
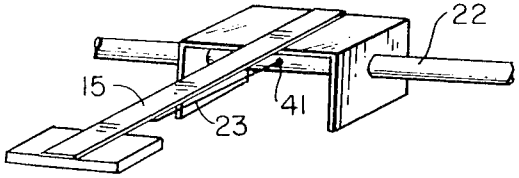

Referring to FIG. 10, the final step in the assembly is securing the spring bias wire 23 between the lever arm 15 and the rod 22. The spring 23 is a spring wire with a 90 degree angle at the top which gives the arm section spring action. The wire is number 72 wire. The straight end of the wire fits into the aperture 41 in the rod 22 and then is secured to the lever arm 15 which may also contain an aperture for holding the wire spring. The spring 23 can then be soldered or otherwise glued into both apertures to form a complete lever arm unit.

Figure 11:
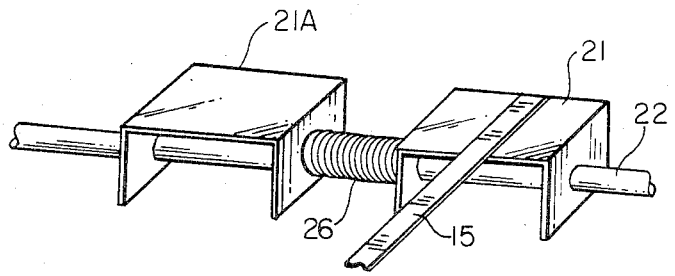

Referring to FIG. 11, there is shown two lever arm units aligned and separated by means of the spacers 26. Spacers 26 may be brass tubes or rubber, plastic or any suitable material and essentially serve to keep the proper separation between lever arm units associated with the stringed instrument.

Figure 12:
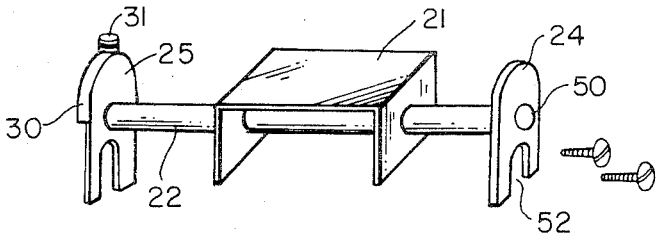

Referring to FIG. 12, there is shown the supports 24 and 25 which as seen in FIG. 1 are secured to the neck of the instrument. The supports 24 and 25 serve to support the rod 22 and the associated lever arm assemblies including the U-shaped housings 21. The right lever arm 25 is associated with the set screw 31 and the washer 30. The left support arm has an aperture 50 to accommodate the other end of the rod 22. The slots as 52 are secured to the neck of the instrument as shown in FIG. 1 and are screwed in position to hold the entire assembly firmly. The purpose of the slots 52 is to allow the musician to adjust the height or the distance between the pads 17 and the strings to obtain a desired feel while further obtaining a correct positioning.

The purpose of the set screw and washer assembly is to allow one to adjust the clockwise or counter-clockwise position of the rod 22 so that the entire arm assembly can be lined up correctly. When this adjustment is made, the set screw is tightened so that everything is securely in place. It is, of course, understood that multiple sections can be accommodated as shown for example in FIG. 3.

Figure 13:
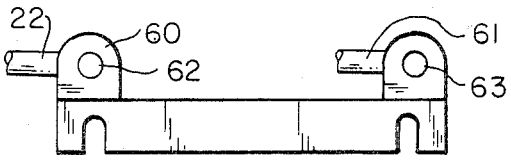

Referring to FIG. 13, there is shown a different side bracket which can be employed so that two complete lever assemblies as there shown in FIG. 3 can be positioned on the neck of the instrument at the same time. The upstanding members 60 and 61 of FIG. 13 are completely analogus to the support members 24 and 25 with the apertures 62 and 63 accommodating the ends of the associated rod as 22.

From the above description, it is understood that this assembly is extremely economical while enabling a musician to contact the lever arm to thereby cause the associated pad to contact the correct string at the same exact spot. Therefore, contacting of the strings by means of these lever arms will always occur at the same place thereby allowing the musician to achieve the same note or the same chord when using this invention.

It is understood that all parts as indicated above can be cast or made of many different materials such as metal, wood, plastic, rubber or any other synthetic material. As indicated, the parts can be cast, molded or stamped and the above noted dimensions are given by way of example only. Thus it will be apparent to those skilled in the art that many alterations can be made and all such modifications and alterations are deemed to be emcompassed within the spirit and scope of the invention.

I claim:

1. Selectively operated lever apparatus to enable the playing of a stringed musical instrument such as a guitar, a banjo, or the like, said instrument including a head and a neck section depending therefrom and a plurality of strings directed from said head to neck section, comprising:

a rod directed across said neck section and positioned above the strings and transverse thereto, a pivotable housing coupled to said rod, an enlongated lever arm secured to said housing at one end and extending above and parallel to at least one of said strings at the other end, a contact pad located on said lever arm at said other end, spring bias means coupled between said lever arm and said rod to allow said housing and therefore said rod to remain out of contact with said string in a first position and to allow said housing to pivot upon application of pressure to said arm in a second position to cause said pad to contact said string whereby said spring means returns said arm to said first position when pressure is removed.

2. The apparatus according to claim 1 wherein said pad is an elastomeric pad.

3. The apparatus according to claim 1 wherein said housing is a U-shaped member, having first and second coaxial apertures in the sides for accommodating said rod, with the top surface of said U-shaped member positioned above said rod.

4. The apparatus according to claim 4 wherein said lever arm is a tubular member of an oval cross section.

5. The apparatus according to claim 5, wherein said lever arm is soldered to said top surface of said U-shaped member.

6. The apparatus according to claim 1 wherein said spring biasing means is a spring wire coupled at one end to said arm and directed downwardly from said arm and then bent at an angle as coupled to said rod.

7. The apparatus according to claim 1 wherein said rod has a plurality of pivotable housings coupled thereto, one for each string of said instrument, with each housing associated with its own lever arm, contact pad and spring biasing means to thereby enable any one of said strings to be selectively actuated.

8. The apparatus according to claim 7 wherein said contact pads of each of said arms are located above an individual string associated with a fret location.

9. The apparatus according to claim 1 wherein there is included first and second rod supporting brackets secured to said neck section at opposite sides and facing one another, with each of said supporting brackets having a rod accommodating aperture.

10. The apparatus according to claim 9 wherein one bracket is coupled to said rod by adjustable coupling means to allow the rod to be moved either clockwise or counter-clockwise to thereby adjust the distance between said strings and said arms.

11. The apparatus according to claim 1 further including an angle bracket coupled to said lever arm at said other end for accommodating said contact pad.

12. The apparatus according to claim 11 wherein said contact pad is rubber and is bonded to said angle bracket.

13. The apparatus according to claim 12 wherein said bonding is accommodated by glue.

14. The apparatus according to claim 1 wherein said housing, lever arm and rod are fabricated from metal.

15. The apparatus according to claim 1 wherein said housing, lever arm and rod are fabricated from plastic.

16. The apparatus according to claim 14 wherein said metal is brass.

17. The apparatus according to claim 9 wherein said first and second supporting brackets are adjustably secured to said neck section to allow one to adjust the distance between said arms and said strings.

18. The apparatus according to claim 7 wherein each of said housings are spaced apart on said rod by spacers encircling said rod to enable the associated pads to contact each of said associated strings.

19. The apparatus according to claim 18 wherein said spacers are metal.

20. The apparatus according to claim 18 wherein said spacers are plastic.

* * * * *